United States Patent [19]

Mozingo

[11] Patent Number: 4,932,178

[45] Date of Patent: Jun. 12, 1990

[54] COMPOUND TIMBER-METAL STRESSED DECKS

[76] Inventor: Ralph R. Mozingo, Box 163A, R.D. #1, Spring Mills, Pa. 16875

[21] Appl. No.: 348,197

[22] Filed: May 5, 1989

[51] Int. Cl.[5] ..... E04C 3/10

[52] U.S. Cl. ..... 52/227; 52/228

[58] Field of Search ..... 52/90, 223 R, 223 L, 52/227, 228

[56] References Cited

U.S. PATENT DOCUMENTS

| | | | |
|---|---|---|---|
| 1,807,715 | 6/1951 | Tucker | 52/227 X |
| 2,836,862 | 6/1958 | Jones | 52/227 |
| 3,045,294 | 7/1962 | Livezey, Jr. | 52/227 X |
| 3,605,360 | 9/1971 | Lindal | 52/730 X |
| 4,442,149 | 4/1984 | Bennett | 52/227 X |

*Primary Examiner*—David A. Scherbel
*Assistant Examiner*—Creighton Smith
*Attorney, Agent, or Firm*—Thomas E. Sterling

[57] ABSTRACT

This invention relates to a bridge deck comprised of longitudinally positioned timbers having metal plates inserted between the timbers. Transversely positioned rods apply compressive forces to the timbers and metal plates. Resulting friction causes bridge deck components to behave as a single unit. The metal plates are inserted between timbers of various sizes and lengths of the stressed deck bridge. Proper transverse stressing of component parts by use of high strength steel rods or tendons allows shear and flexural stresses, caused by applied loads, to be transferred between plates and timbers by friction alone without glue or metal fasteners. Deflections, caused by applied loads, are greatly reduced when properly designed plates are employed. Without plates, the use of stressed timber deck bridges, under today's highway loads, is limited to short spans with large timber dimensions. Such structures are handicapped economically when compared with other types of bridge systems such as prestressed concrete or composite concrete-steel bridges. Properly designed and inserted plates have been shown to greatly improve the structural performance of stressed timber decks.

20 Claims, 3 Drawing Sheets

COMPOUND TIMBER-METAL STRESSED DECKS

FIELD OF THE INVENTION

This invention relates to bridge decks and in particular to transversely compressed bridge decks comprised of timber and metal.

SUMMARY

The low modulus of elasticity of wood leads to excessive deflections and span length limitations of stressed timber deck bridges. By use of model testing, as well as static and dynamic testing of a 40 foot prototype deck, applicant has shown how the use of metal plates, sandwiched between timbers before transverse stressing of the timber deck, can reduce deflections considerably. Longer spans, smaller timber depths, better camber control, reduced creep, and better orthotropic behavior are all possible when metal plates are properly employed. Simple and continuous bridges with partial length plates become feasible. Moreover, timber butt joints and wood defects are very effectively spliced by the plates, permitting the use of lower grade timber in shorter lengths and smaller cross-sections. Bridge deck vibrational characteristics are improved. Fabrication and erection are simple. Most importantly, steel plates are hidden from view so that the natural beauty of this bridge-type is retained.

BACKGROUND OF THE INVENTION

A stress-laminated bridge deck behaves like a solid plate with a width equal to the bridge width and a length equal to the span. The structural action of this deck differs from beam action in that stresses and strains are distributed in two rather than one direction (orthotropic behavior), which results in a strong and predictable structure. For long span bridges, this type of deck may be used to span between main girders or transverse floor beams.

This deck slab is formed from individual timbers placed side by side and then compressed tightly together with large lateral forces. High strength steel rods (thread bars), or tendons are usually used to provide these high forces in the neighborhood of 60,000 to 120,000 pounds per rod. Alternatively the tensioning members or rods may be made of high strength plastic, such as fiber glass reinforced plastic (fiber glass) or other plastics or polymers. These rods may be rigid, flexible or cable-like. Unlike bolt forces of the past used to hold laminated timber beams, frames, and trusses together where nuts on threaded bolts were wrench tightened, these high rod forces are produced with the use of hollow-core hydraulic jacks to very large precalculated design magnitudes, in a measured fashion. Such forces squeeze the timbers, greatly increasing frictional resistance between timbers and eliminating the need for mechanical connectors or glue used in various ways with laminated wood beams. As a consequence, increased strength properties and resistance to deflections are realized in the transverse as well as the longitudinal direction of the bridge.

Creep of the wood perpendicular to the grain occurs soon after jacking of the rods. Consequently, a second rod jacking is required after about 24 hours. Further creep has been found to occur very slowly. However, as a final safeguard, a third rod jacking is performed after about two months. Experience with existing bridges indicates that further jacking is unnecessary and that rod forces will be stable after the third jacking. Such strengthening allows timbers of short length to be butted at their ends in a staggered pattern to form the overall length of bridge deck.

The rod stressing and resulting transverse compression of the timbers improves bridge performance. This should not, however, be confused with the prestressing of timber beams and frames in flexure. No longitudinal flexural prestressing is imposed here prior to the application of bridge loads.

Stress-laminating was first used in Ontario, Canada in 1976. Since then this bridge type, without metal plates, has become popular in Canada and, more recently, in the United States. Results of tests conducted at the University of Wisconsin have shown that the major shortcoming of the stress-laminated bridge deck is lack of stiffness when used over a long span. The mode of failure is excessive deflection. Resulting timber stresses are usually well within allowable values. The Trout Road Bridge, built in May 1987 near Houserville, Pa., has been successfully monitored for one year. Dead and live load deflections, losses in bar forces, and moisture content of the creosoted timber deck were observed and analyzed. Results indicate a well-behaved and esthetically pleasing bridge type for short spans. However, measured live load deflections were found to be in excess of allowable deflections specified in highway bridge specifications. The 46′ span of this bridge obviously required timbers to be butted together at intervals. The usual procedure has been to limit butt joints no closer than every fourth member at any given bridge cross-section. Large Douglas Fir timbers (4″×16″) with a maximum length of 20 feet were used. Such large dimensions are scarcely procurable in most sections of the country. To fully utilize smaller timber cross-sections and lengths, butt joints must be spliced such that resulting bridge deflections remain within allowable values.

Renewed interest in the use of wood for bridge construction has arisen because of its cost effectiveness compared with other materials. The U.S.D.A. Forest Service is particularly interested in stress-laminated structures because they can be constructed by in-house labor in a very short period of time. State and township governments are also interested in stressed timber bridges to economically replace thousands of deficient structures in a rapid and efficient manner. But before the stress-laminated bridge deck can be fully utilized, the lack-of stiffness (excessive deflection) shortcoming must be properly addressed.

The use of metal plates described in this invention offers the solution to the reduction of excessive deflections and provides other structural advantages as well.

An object of this invention is to produce a compound timber-metal stressed deck in which permanent set (creep) caused by long-time loads is minimized; camber is better retained and dead and live load deflections are reduced.

Another object of this invention is to produce a stressed deck in which longer simple spans are possible, and in which reduced depth of timbers is possible.

Yet another object of this invention is to produce a stressed deck having continuous spans with plates in regions of high moments, leading to economy of materials.

Yet another objects of this invention is to design a compound timber-metal stressed deck in which the transverse sag of the deck cross-section can be countered by the addition of extra metal plates where the sag is largest.

Still another object of this invention is to produce a compound stress deck in which orthotropic action is improved as well as flexural rigidities parallel and perpendicular to the direction of traffic with improved torsional rigidity.

Yet another object of this invention is to produce a bridge span wherein the transverse wheel load distribution is improved.

Still another object of this invention is to produce a bridge span utilizing shorter timber lengths wherein camber is easier to form.

Still another object of this invention is to produce a compound timber-metal bridge span with smaller and nearly square cross-sections employed in two or more layers, allowing smaller diameter trees to be utilized.

Another object of this invention is to produce a bridge span in which low grade timber may be effectively used in combination with metal plates and in which the loss in bridge stiffness at butt joints is minimized.

Yet another object of this invention is to produce a bridge deck in which stressed rod forces are more uniformly distributed transversely through the timbers when metal plates are employed, giving better friction distribution; also, a higher percentage of initial rod forces are retained which allows smaller rod forces with reduced damage to facia timbers caused by compressive pressure under the bearing plates.

Still another object of this invention is to design a timber deck bridge with improved vibrational characteristics wherein the metal plates cause the structure to have a higher natural frequency and a lower amplitude of vibration.

Yet another object of this invention is to produce simple bridge fabrication in which the metal fabrication consists of plate shearing and hole drilling only.

Yet another object of this invention is to produce a bridge span in which high strength steel plates can be shipped in convenient lengths and butt welded at the site in which no painting or galvanizing of the metal plates is required.

Another object of this invention is to build a bridge of reduced depth with less constriction to the effects of high water.

Yet another object of this invention is to construct a bridge of reduced depth which will allow for more economical design of abutments, piers, and approaches.

A final object of this invention is to produce a bridge span having natural beauty of the timber deck - the metal plates are hidden from view.

These and other obvious features and advantages of the present invention will become more obvious from the following description, drawings, and claims which show, for purposes of illustration, embodiments in accordance with the present invention.

BRIEF DESCRIPTION OF THE DRAWINGS

FIG. 1, is a three-dimensional view of this invention, incorporated in a bridge design, showing longitudinal timbers with metal plates interspersed between.

DESCRIPTION OF PREFERRED EMBODIMENT

Figure 1:
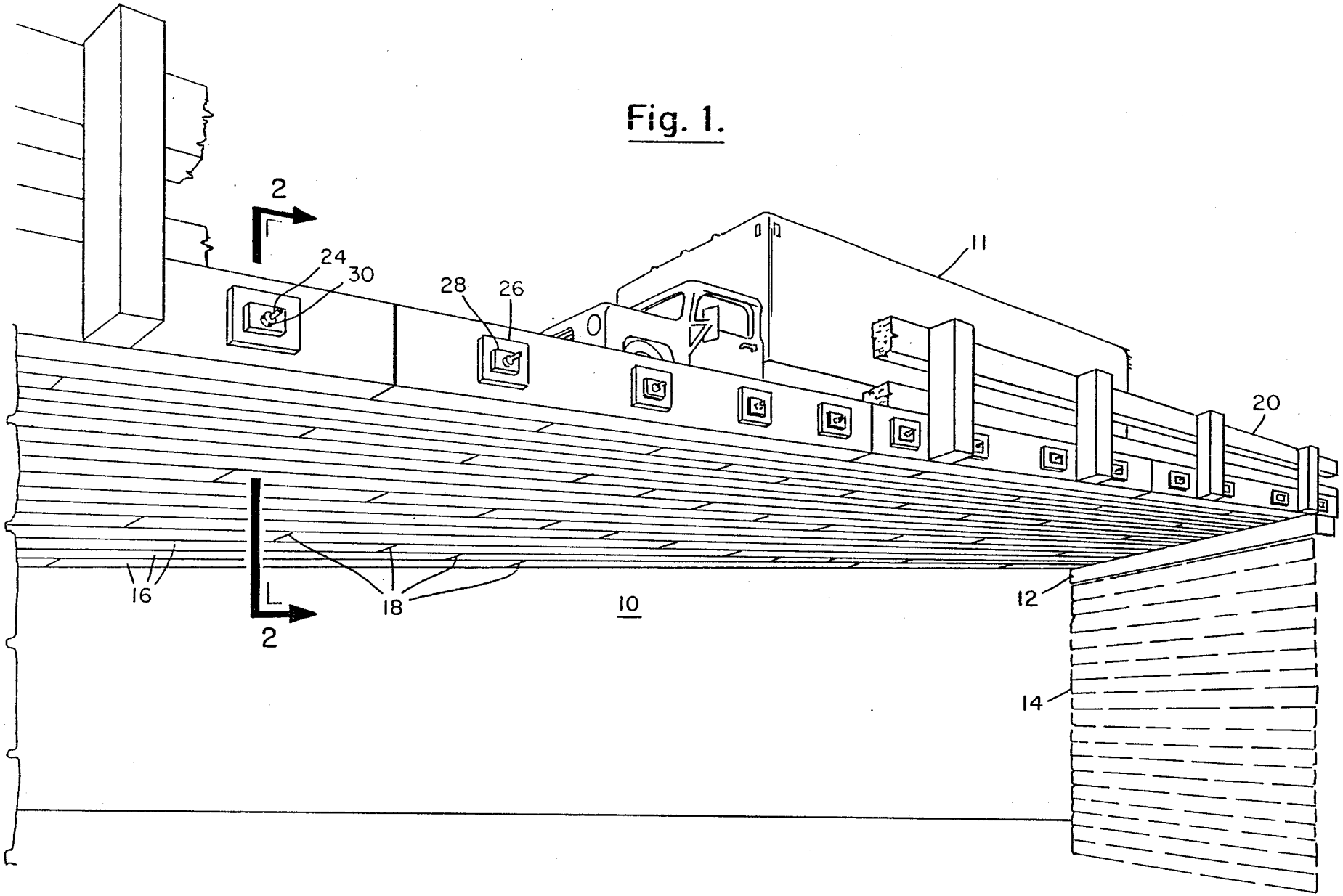

Referring to the drawings and in particular to FIG. 1, there is shown a stressed bridge deck 10 in accordance with the present invention. The deck 10 rests upon sills 12 which in turn rest upon abutments 14. The timbers 16 are placed side by side in the direction of traffic flow on the bridge or longitudinally. The timbers 16 are staggered in length leaving butt joints 18 so staggered that butt joints 18 of longitudinal lengths of timbers are not located adjacent to each other. The butt joints 18 may be positioned sequentially as is indicated in FIG. 1, so as to be staggered. The deck 10 may also have a railing or side piece 20 (shown in broken section) attached to the deck. Sills 12 may be comprised of wood, plastic, neoprene, rubber or a combination of these.

Figure 2:
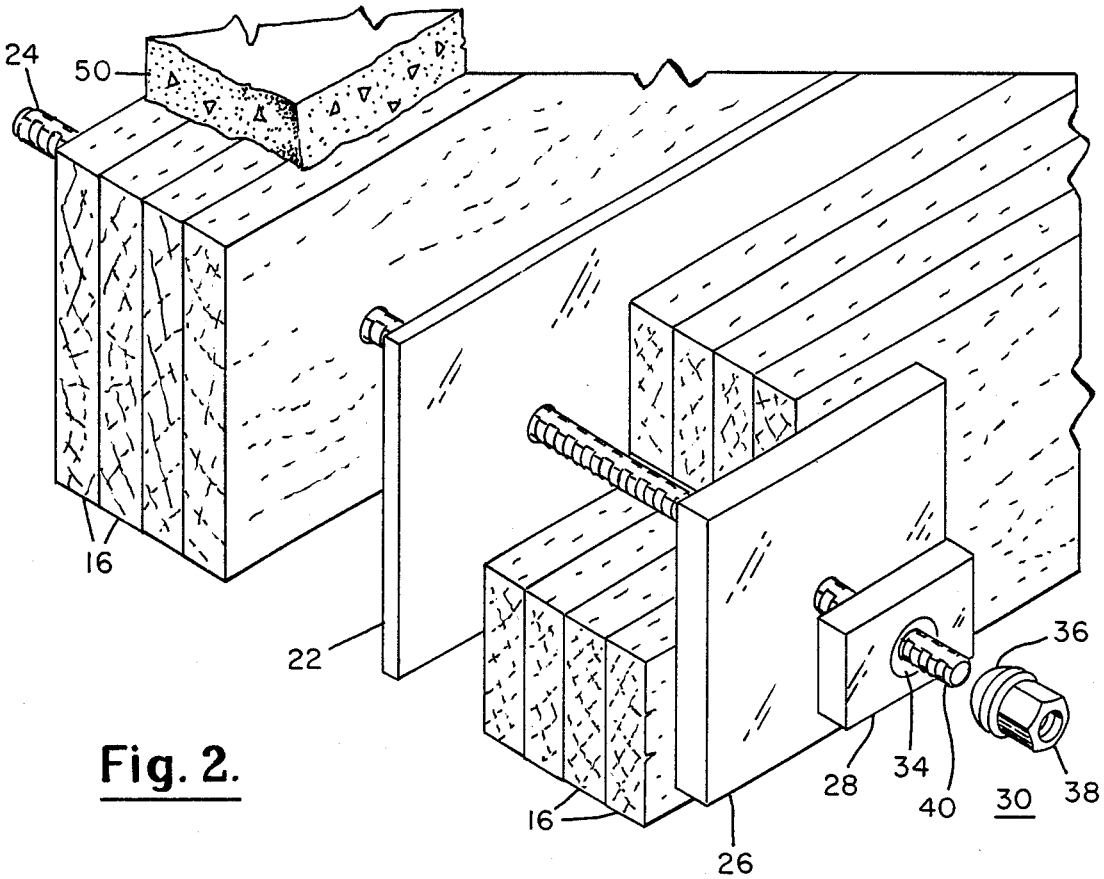
FIG. 2, is a partially exploded three-dimensional view (partially in section) showing of the bridge deck adjacent to a tensioning rod.
Figure 3:
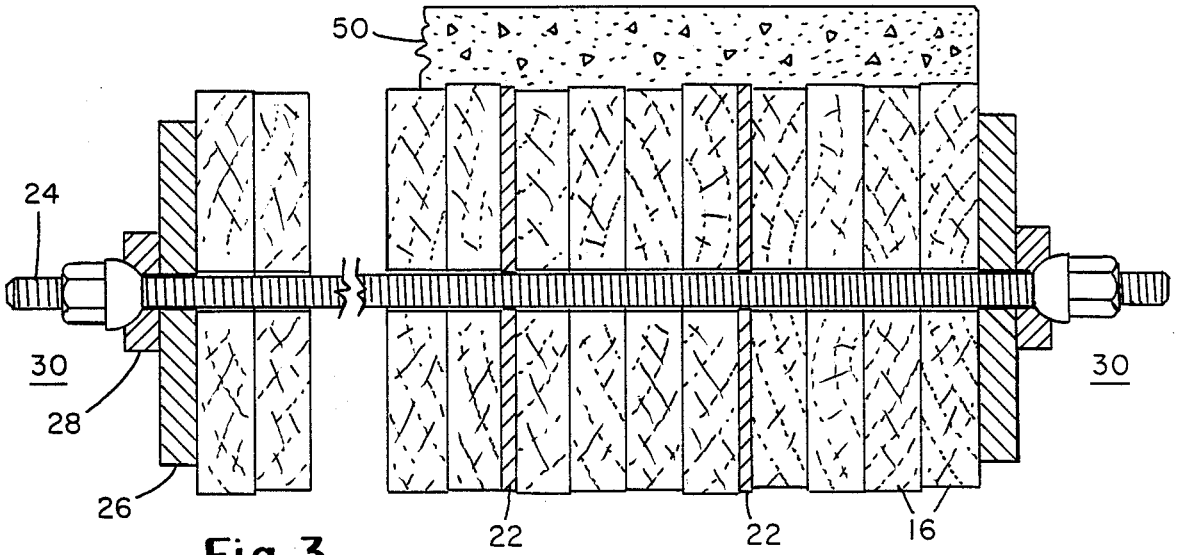
FIG. 3, is a broken cross-sectional view 2—2 indicated in FIG. 1.

Metal plates 22 shown in FIGS. 2 and 3 sandwiched between timbers 16, may extend the entire length of deck 10. However, the metal plates 22 need not be the full length of the deck 10. Because the deck 10 deflects most near the center, more or thicker plates could be used in the central region. Near the outside edges of the deck, near railings 20, fewer and shorter plates may be utilized to effect economy. In any case plates 22 need not be placed between all timbers but must be placed in accordance with the engineering design to limit deflections, flexural stresses and creep. At regions of the bridge cross-section where wheel loads are most likely to be applied, plates 22 may be used in groups of two or three to give added structural resistance to large deflections. In FIGS. 2 and 3, the metal plates 22 are positioned one every four timbers 16 for purposes of illustration. Metal plates 22 may be placed between any sequence of timbers. For example, between every timber, between every 2, 3, 4, 5 . . . n. timber depending on the particular design requirements of the deck 10 (where n is any positive number).

Referring now to FIGS. 1, 2 and 3, tensioning members or high strength tensioning rods 24 extend transversely through all of the timbers 16 and sandwiched plates 22. Each rod 24 is anchored on either side of the deck 10 by a bearing plate 26 positioned adjacent to a side timber 16 positioned on the side portion of deck 10. Tensioning member or rod 24 extends through bearing plate 26 and through a smaller anchor plate 28 adjacent thereto and is held in position by an anchor nut 30 which bears directly into anchor plate 28. Rods 24, extend through the deck 10 in a transverse direction with longitudinal spacing in accordance with good engineering design to provide adequate deck behavior with a suitable factor of safety. Rods 24 are anchored on the side portion of deck 10 by identical bearing plates 26, anchor plates 28 and anchor nuts 30. Tensioning members 24 may be externally threaded rods, flexible cables, or wires utilizing an appropriate tensioning and holding device. Likewise rods 24 without external threads may be used with proper tensioning and securing devices. Bearing plates 26 may be replaced by continuous metal channels running the length of the timbers 16 or by sections of suitable metal shapes. Tensioning members or rods 24 may be comprised of metal, usually high strength steel. They may also be made of high strength plastic such as fiber glass reinforced plastic (fiber glass) or other plastics or polymers.

In the construction of the bridge, a hollow-core hydraulic jack 32 is attached to the end portion of the rods 24 to bear against anchor plate 28. This hydraulic jack 32 produces an initial tensioning on rods 24 to a very high magnitude. In the Trout Road bridge design a tensioning of 80,000 pounds was used. Generally, rod tensioning and spacing are chosen after careful analysis for a particular bridge. Tension forces of from 60,000 to 120,000 pounds may be used. As may be seen, the timbers 16 and metal plates 22 are subjected to a very intense compressive force by the tensioning of rods 24. This high pressure causes interlocking friction between these elements to fuse the timber 16 and metal plates 22 into a unified deck which performs with great efficiency.

It is also in the contemplation of this invention that the metal plates 22 may have mechanical connectors on their lateral surfaces designed to engage and hold the adjacent timbers 16. Such connectors could be pointed protrusions, perforated plates or those with holes therethrough. Deformed plates and deck plates also could be used. Likewise timbers 16 could be secured by adhesive on their adjoining surfaces, securing them together and to metal plates 22. Gluedlaminated (glu-lam) panels may be used with plates 22 between the panels. It is further in contemplation of this invention that other structural shapes such as structural tees, wide-flange beams, or built-up metal sections may be used in place of metal sandwiched plates.

Butt joints 18 are necessary because, in most cases, timbers with lengths equal to the deck length are either not available or too expensive. In some bridge designs, the outside edges of the deck 10 may use fewer and shorter metal plates 22, to effect economy. In any case plates 22 need not be placed between all timbers but must be placed in accordance with the engineering design to limit deflections, flexural stresses, and creep to acceptable values. In the design of the deck 10, one-inch-diameter rods were spaced at 3'-6" along the bridge length. Rod spacing of from one to six feet is possible. Smaller rods used at close spacing but in a staggered pattern might also be used to give a more uniform pressure (friction) distribution between plates and timbers. Special bearing plates 26, anchor plates 28 and anchor nuts 30 are required for the high strength rods 24. Extra strong rod threads 40 are positioned on the outer surface of rods 24. These are required to guarantee sufficient friction between timbers 16 and metal plates 22 and between timber and timber. Bearing plates 26 with insufficient contact area have been known to cause excessive crushing of wood fibers at the plate edges. For this reason, Canadian engineers have used continuous steel channels along the bridge length in place of anchor plates. This procedure may be used with the present invention.

It should be noted that anchor plate 28 has a spherical indentation 34 into which a spherical bearing surface 36 of anchor nut 30 is positioned. These spherical surfaces 36 are necessary to insure a uniform distribution of pressure between components when slight rod bending takes place due to deflections caused by bridge weight. The hex portion 38 of this special anchor nut 30 is tightened inside of the hollow-core jack 32 during the jacking operation. Hex portion 38 engages rod threads 40 of rod 24. Again it should be noted that identical bearing plate 26, anchor plate 28 and anchor nut 30 are positioned at each end of rod 24 on each side of the deck 10. In American practice, bridge deck units 5 to 8 feet wide are prefabricated and shipped to the site where rod couplers (not shown) are employed between units prior to assembly and final rod tensioning. This practice may be utilized in this invention. In practice a road surfacing layer 50 (usually asphalt) is placed on the upper surface of deck 10 to resist the road traffic wear and to protect deck components from the weather.

Tests have shown that when about 7% of the timber cross-section is furnished as high strength steel plates (yield strength equals 50 Ksi) the bridge stiffness effectively doubles. This fact attests to the ability of steel, with its high modulus of elasticity, to compensate for the inability of timber, with a low modulus, in so far as excessive deflections are concerned. Moreover, timber lengths could be reduced by 40% when steel plates are present to more effectively splice butt joints and to allow butt joints to be employed every second instead of every fourth timber in a given bridge deck cross-section.

Figure 4:
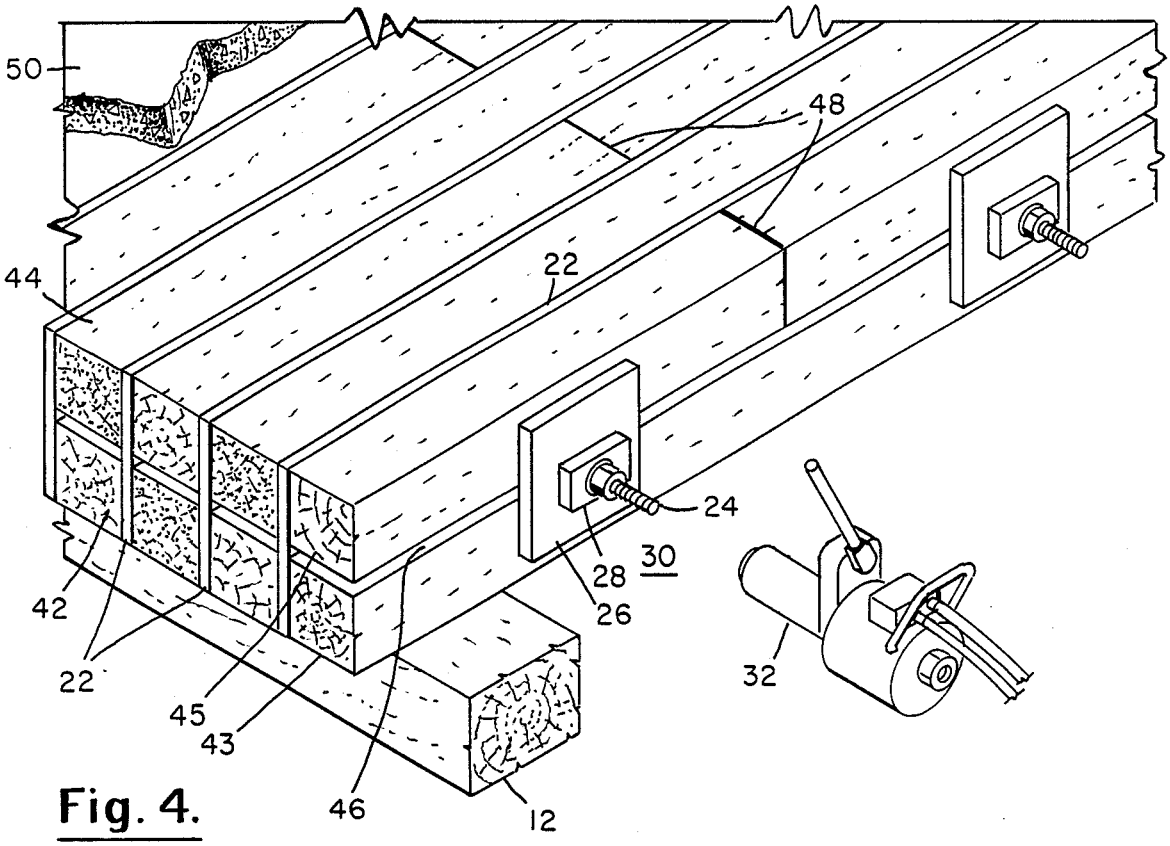
FIG. 4, is a three-dimensional view of a modification of the invention (partially in section) showing a two-layer bridge deck.
Figure 5:
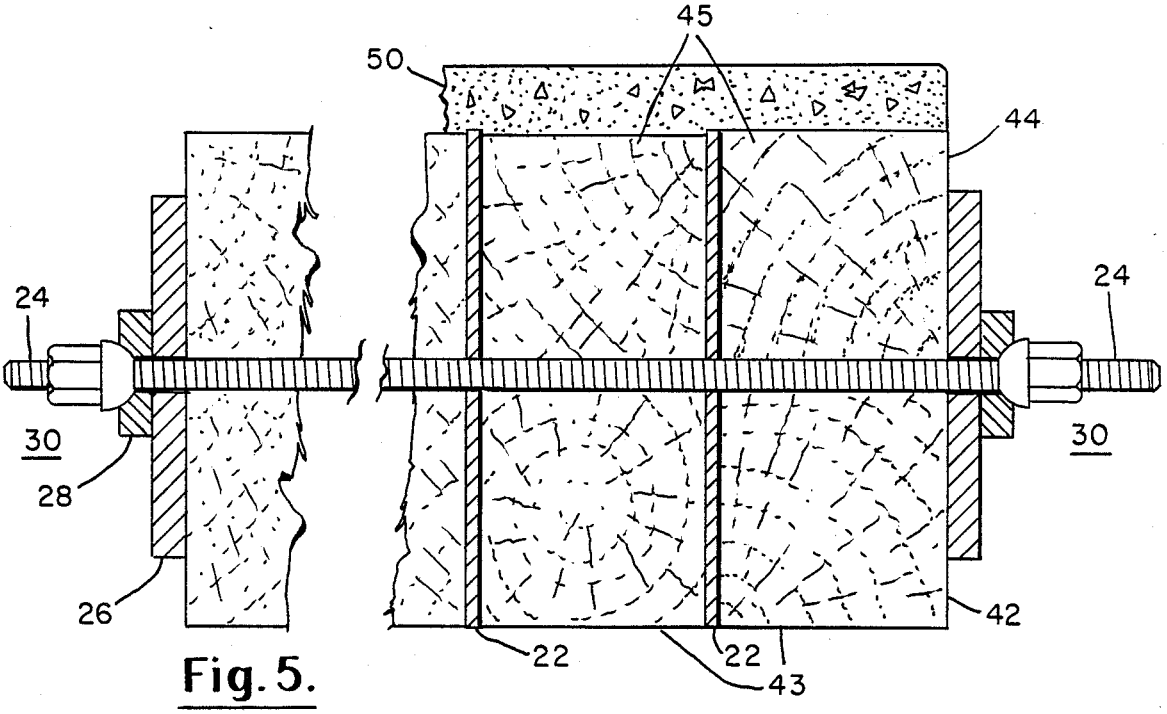
FIG. 5, is a vertical cross-sectional view (partially in section) taken through the tensioning rod of FIG. 4, showing two layers of approximately square timbers comprising the deck.

Referring now to FIGS. 4 and 5, there is shown a modification of the invention previously described using upper and lower layers of timbers instead of a single layer. Upon timber sills 12 is positioned a first layer of timbers 42 (usually square) adjacent to one another and extending the length of deck 10 with butt joints 48, as required. A second layer of timbers 44 (usually square) is positioned directly above the first layer of timbers 42 separated by a rod gap 46 through which high strength rods 24 pass transverse to the first and second layer of timbers 42 and 44. The rod gap 46 is usually, but not necessarily, equal to the diameter of the rod 24. In this modification, bearing plates 26, anchor plates 28 and anchor nuts 30 on each end of rods 24 bear against both the first and second layer of timbers 42 and 44, compressing them. Metal plates 22 (of appropriate size) are vertically positioned to connect the first and second layers of timbers 42 and 44. In this example, metal plates 22 are positioned between each individual timber 43 and 45 in the first and second layer of timbers 42 and 44. In practice, plates 22 may be positioned in any sequence between any number of timbers in said first and second layer of timbers 42 and 44. That is, between each timber, each second, third, fourth . . . or nth timber, (x being any positive number), or in an unsequenced manner depending on the design characteristics of the span. Plates 22 may extend the entire longitudinal length of the bridge deck. As with the invention of FIGS. 1, 2 and 3, alternative arrangements of the metal plates 22 is possible. Butt joints 48 at the end of each timber are positioned alternately so that the butt joints at a given cross-section are staggered. Such arrangement permits the use of shorter length timbers.

The rods 24 of this modification, pass through rod gap 46 between the first layer of timbers 42 and the second layer of timbers 44, hence the timbers and metal plates 22 require no drilling of holes. The tensioning members or rods 24 could, of course, pass through top and bottom timber layers 42 and 44 if desired. The tensioning of rods 24, in this case, is done in the same manner as described relative to the deck illustrated in FIGS. 1, 2 and 3 utilizing hollow-core hydraulic jack 32. It is also in contemplation of this invention that more than two layers of timbers be used with tensioning members or rods 24 between or through the layers of timbers to provide structural advantages similar to those described for one and two layer systems.

The first and second layer of timbers 42 and 44 are held in place and transfer stresses to the metal plates 22 by friction alone. Model tests have shown no slippage between the timbers and metal plates, even when an overload was applied to the structure. These tests have also shown that when 9% of the deck cross-section is steel, the flexual rigidity is increased to 2.25 times that of a structure with the same cross-sectional dimensions but with solid timbers and no metal plates. As with the deck of FIGS. 1, 2 and 3, proper rod tensioning is imperative such that sufficient friction between the components exists to transfer flexural and vertical shear stresses adequately. Unlike the deck structure of FIGS. 1, 2 and 3, where part of all the horizontal shear is taken by the timbers 16, the entire horizontal shear of this modification must be resisted by the metal plates 22.

Although this invention has been described with a degree of specificity, it is understood that numerous changes in construction and design may be made without departing from the spirit of this invention.

What is claimed is:

1. A composition bridge deck longitudinally positioned in the direction of traffic flow and having lateral surfaces thereon, comprising in combination:

a plurality of longitudinally positioned timbers comprising a plurality of timbers longitudinally butted against each other to form butt joints, said butt joints being positioned to lie adjacent to segments of continuous timbers;

a plurality of plates longitudinally positioned between said timbers in any ratio of plates to timbers;

a plurality of tensioning members transversely extending through said plurality of timbers and through said plurality of plates;

tensioning means positioned on the end portion of each of said tensioning members, and in pressure contact with the lateral surfaces of said bridge deck, said tensioning means comprised of, in combination:

bearing plates positioned on opposite lateral surfaces of said bridge deck;

anchor plates in pressure contact with said bearing plates, said tensioning members extending through said bearing plates and said anchor plates;

anchor nuts on the end portion of said tensioning members and in screw relationship thereto, said anchor nuts in pressure contact with said anchor plates;

said tensioning means and tensioning members adapted to maintain transverse pressure on said plurality of timbers and said plurality of plates.

2. The combination as claimed in claim 1, in which both longitudinal ends of said bridge deck are supported by transverse sills.

3. The combination as claimed in claim 2, comprising in combination:

anchor plates having semi-spherical indentations therein;

anchor nuts having semi-spherical protrusions thereon in pressure contact with said semi-spherical indentations in said anchor plates.

4. The combination as claimed in claim 3, in which said tensioning members are comprised of rods.

5. The combination as claimed in claim 4, in which said tensioning members are comprised of steel.

6. The combination as claimed in claim 5, in which said tensioning members are comprised of fiber glass reinforced plastic (fiber glass).

7. The combination as claimed in claim 6, in which said tensioning members are comprised of cables.

8. The combination as claimed in claim 7, in which said transverse sills are comprised of timber.

9. The combination as claimed in claim 8, in which said transverse sills are comprised of neoprene pads.

10. The combination as claimed in claim 1, in which said anchor nuts are replaced by anchorage devices positioned on the end portion of said tensioning members, said anchorage devices in pressure contact with said anchor plates.

11. A bridge deck longitudinally positioned in the direction of traffic flow and having lateral surfaces thereon, comprising in combination:

a first layer of longitudinally positioned timbers;

a second layer of longitudinally positioned timbers positioned above said first layer with a rod gap in between said first layer and said second layer of longitudinally positioned timbers;

said first and said second layers of longitudinally positioned timbers being comprised of a plurality of timbers butted against one another to form butt joints;

metal plates positioned in between the timbers in said first and said second layer of timbers;

a plurality of tensioning members transversely extending through said rod gap between said first and said second layer of timbers;

tensioning means positioned on each end portion of said plurality of tensioning members and in pressure contact with the lateral surfaces of said bridge deck; said tensioning means comprised of, in combination:

bearing plates in pressure contact with each lateral surface of said bridge deck;

anchor plates in pressure contact with said bearing plates, said bearing plates and said anchor plates having the end portion of said tensioning members extending therethrough;

anchor nuts in threaded relationship with said tensioning members and in pressure contact with said anchor plates;

sills upon which the longitudinal end portions of said bridge deck rests.

12. The combination as claimed in claim 11, in which said butt joints are adjacent to segments of continuous timber.

13. The combination as claimed in claim 12, in which the cross section of said timbers in said first and said second layer of timbers is approximately square in shape.

14. The combination as claimed in claim 13, in which said metal plates are comprised of steel.

15. The combination as claimed in claim 14, in which said bridge deck has a asphalt coating on the upper surface thereof adapted to resist the wear of road travel.

16. The combination as claimed in claim 15, in which said tensioning members are comprised of steel.

17. The combination as claimed in claim 16, in which said tensioning members are comprised of fiber glass reinforced plastic (fiber glass).

18. The combination as claimed in claim 17, in which said plurality of metal plates are positioned in any sequence between any number of timbers in said first and said second layer of timbers.

19. The combination as claimed in claim 18, having multilayers of longitudinally positioned timbers clamped together one layer above the other.

20. The combination as claimed in claim 11, in which said anchor nuts are replaced by anchorage devices positioned on the end portion of said tensioning members, said anchorage devices in pressure contact with said anchor plates.

* * * * *